US006779688B1

(12) United States Patent
Mayer

(10) Patent No.: US 6,779,688 B1
(45) Date of Patent: Aug. 24, 2004

(54) CATCH BASIN FOR A CONCRETE PUMPING DEVICE

(75) Inventor: Martin G. Mayer, Racine, WI (US)

(73) Assignee: Putzmeister, Inc., Sturtevant, WI (US)

( * ) Notice: Subject to any disclaimer, the term of this patent is extended or adjusted under 35 U.S.C. 154(b) by 0 days.

(21) Appl. No.: 10/266,397

(22) Filed: Oct. 8, 2002

(51) Int. Cl.[7] ..... B67D 1/16

(52) U.S. Cl. ..... 222/108; 222/571; 137/312; 137/615; 141/86; 141/88; 141/311 R

(58) Field of Search ..... 222/108, 571; 137/312, 571, 615; 141/86–88, 271, 311 R, 377, 387

(56) References Cited

U.S. PATENT DOCUMENTS

| | | | | | |
|---|---|---|---|---|---|
| 956,562 | A | * | 5/1910 | Beers et al. | 137/71 |
| 1,520,511 | A | * | 12/1924 | Reymore | 137/313 |
| 3,131,711 | A | * | 5/1964 | Delaney | 137/286 |
| 4,877,155 | A | * | 10/1989 | Tull | 222/108 |
| 5,165,574 | A | | 11/1992 | Ratcliffe | 222/108 |
| 5,256,005 | A | * | 10/1993 | Beck, III | 405/240 |
| 5,325,897 | A | | 7/1994 | Richardson et al. | 141/86 |
| 5,339,872 | A | * | 8/1994 | Marino | 141/1 |
| 5,460,301 | A | | 10/1995 | Ebinger et al. | 222/626 |
| 5,470,011 | A | * | 11/1995 | Jordan | 222/108 |
| 5,690,138 | A | * | 11/1997 | Fuller | 137/312 |
| 5,725,009 | A | * | 3/1998 | Mallow et al. | 137/15.09 |
| 5,823,218 | A | * | 10/1998 | Schlecht et al. | 137/2 |
| 6,068,025 | A | | 5/2000 | Schlecht | 138/109 |
| 6,230,741 | B1 | * | 5/2001 | Woodling et al. | 137/615 |
| 6,244,477 | B1 | | 6/2001 | Hudelmaier | 222/527 |
| 6,390,504 | B1 | * | 5/2002 | Fetzer | 280/763.1 |
| 6,427,869 | B1 | | 8/2002 | Corbett | 222/1 |
| 6,588,448 | B1 | * | 7/2003 | Raymond | 137/351 |

* cited by examiner

*Primary Examiner*—David A. Scherbel
*Assistant Examiner*—Frederick Nicolas
(74) *Attorney, Agent, or Firm*—Andrus, Sceales, Starke & Sawall, LLP

(57) ABSTRACT

A system for collecting undesired concrete discharged from the concrete supply pipe of a mobile concrete pumping vehicle. The system includes a catch basin having an outer wall and a bottom wall that define an open reservoir. The catch basin includes an open top end that receives the second, discharge end of a delivery hose connected to the concrete supply pipe that distributes concrete out through the delivery hose. Preferably, the reservoir is sized to receive a sufficient volume of concrete to prevent the undesired discharge of the concrete during movement of the boom arm of the pumping vehicle. The catch basin includes a plurality of suspension straps that suspend the catch basin around the discharge end of the delivery hose during movement of the boom arm. The suspension straps are each connected to a support bracket mounted to the boom arm of the concrete pumping vehicle.

7 Claims, 4 Drawing Sheets

CATCH BASIN FOR A CONCRETE PUMPING DEVICE

BACKGROUND OF THE INVENTION

The present invention generally relates to a mobile concrete pumping vehicle having a hinged boom arm including a supply pipe for delivering pumped concrete to a location remote from the mobile pumping vehicle. More specifically, the present invention relates to a catch basin and flexible delivery hose attachable to the supply pipe to control the undesired discharge of concrete from the delivery hose during movement of the boom arm at a work site.

Presently, mobile concrete pumping vehicles are available that include a multi-section boom arm that is folded into a compact condition during transport. Once the mobile vehicle reaches the work site, the folded boom arm is extended to supply concrete to a remote location. Typically, the boom arm includes a concrete supply pipe that is supported by the boom arm such that concrete can be supplied to a remote location on the work site. The boom arm is rotatable about the vehicle and can be raised and lowered, as well as extended and retracted, to accurately position concrete at the work site.

Currently, some mobile concrete pumping vehicles utilize a flexible, rubber delivery hose that includes a metal fitting on each of its ends. The metal fitting on the upper end of the flexible delivery hose mates with a corresponding fitting contained on the end of the concrete supply pipe. The mated fittings allow the pumped concrete to flow into the flexible delivery hose, which can be handled by an operator to accurately position the pumped concrete at the work site.

When used, the metal fitting on the second end of the delivery hose provides a point of attachment for either a second hose or an end cap that is used to prevent the undesired discharge of concrete from the delivery hose during movement of the boom arm at a work site. The metal end fitting included on the second end of the delivery hose increases both the cost and the weight of the delivery hose, and has the potential danger of building up pressure in the delivery system.

Therefore, it is an object of the present invention to provide a system for controlling the undesired discharge of concrete from the supply pipe of a mobile concrete pump without utilizing a metal end fitting and mating end cap on the discharge end of the rubber discharge pipe. Further, it is an object of the present invention to provide a delivery hose that can be utilized by a worker to direct the flow of discharged concrete from the concrete pump without having the metal end fitting. It is yet an additional object of the present invention to provide a collection system that can capture inadvertently discharged concrete from the end of the discharge tube without the use of an end fitting on the second end of the discharge tube.

SUMMARY OF THE INVENTION

The present invention is a combination system for delivering concrete from a mobile concrete pump having a concrete supply pipe mounted to a multi-section movable boom arm and for preventing the undesired discharge of concrete from the concrete supply pipe during movement of the boom arm. The system of the present invention includes a concrete delivery hose that can be connected to the concrete supply pipe to deliver concrete to a desired location at the work site. The concrete delivery hose extends from a first end to a second end and is preferably formed from a flexible material, such as rubber.

The concrete delivery hose extends from a first end to a second end and includes an end fitting on the first end. The end fitting is configured to mate with a similar end fitting contained on the concrete supply pipe. The mated fittings allow concrete to flow from the concrete supply pipe to the delivery hose for distribution at the work site.

The second end of the concrete delivery hose is formed without an end fitting. The second end of the delivery hose is formed from rubber and can be manipulated by the user at the work site. The elimination of an end fitting from the second end of the delivery hose reduces the weight of the delivery hose.

The system of the present invention further includes a catch basin 30 that can be positioned to surround the second end of the delivery hose. The catch basin includes an outer wall and a bottom wall joined to each other to define a collection reservoir. The collection reservoir has a volume that is sufficient to collect concrete discharged from the second end of the delivery hose. Preferably, the outer wall of the catch basin is cylindrical and defines the open collection reservoir.

The outer wall of the catch basin is sized such that a gap is created between the outer wall of the catch basin and the second end of the delivery hose. Thus, a loose fitting is created between the catch basin and the delivery hose to prevent the build-up of pressure in the delivery hose during use of the catch basin.

The catch basin includes a plurality of suspension straps that extend between the top end of the catch basin and a support bracket mounted to the boom arm of the mobile concrete pump. Each of the suspension straps supports the weight of the catch basin and allows the catch basin to be suspended around the outer wall of the delivery hose.

During normal operation of the mobile concrete pumping vehicle, the catch basin is detached from the support bracket such that the catch basin does not interfere with the concrete pumping operation. Once the boom arm and concrete supply pipe are to be moved, the catch basin is suspended around the second end of the delivery hose. Specifically, each of the suspension straps extends from the catch basin to the support bracket such that the second end of the delivery hose is suspended within the open collection reservoir defined by the catch basin. If concrete falls from the delivery hose, the concrete is retained within the open collection reservoir to prevent the undesired discharge of concrete from the boom arm.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
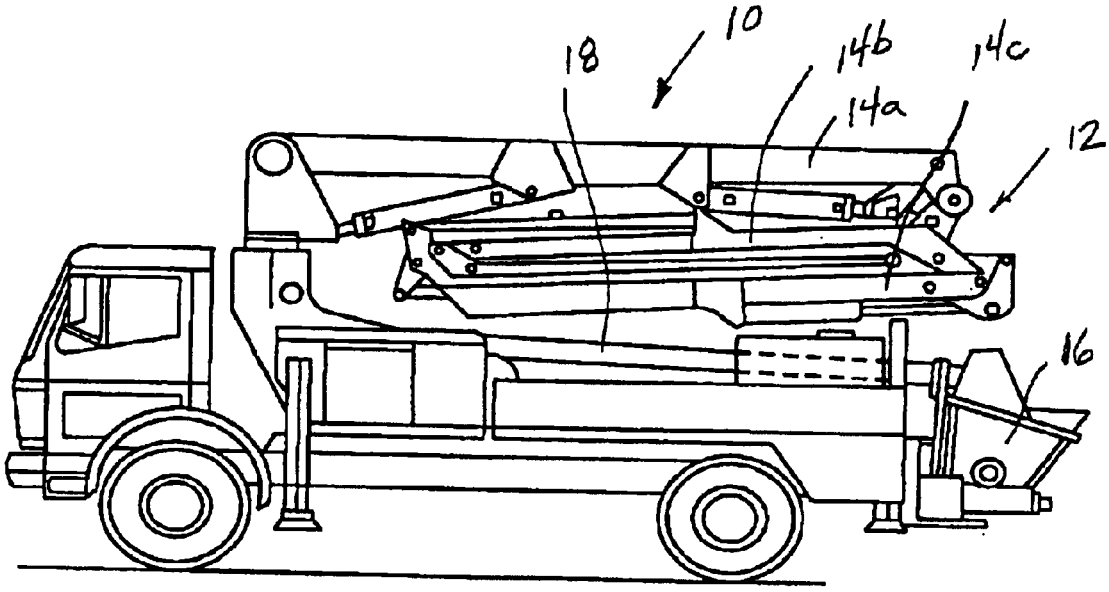
FIG. 1 is a side view of a mobile concrete pumping vehicle incorporating the system of the present invention.

FIG. 1 illustrates a mobile concrete pumping vehicle 10 that includes an extendable boom arm 12 having independent sections 14*a*–14*c* that can be unfolded and extended. Each of the sections 14*a*–14*c* includes a concrete supply pipe that provides a path for pumped concrete to flow from a storage hopper 16 to the outermost tip of the boom arm 12.

Figure 2:
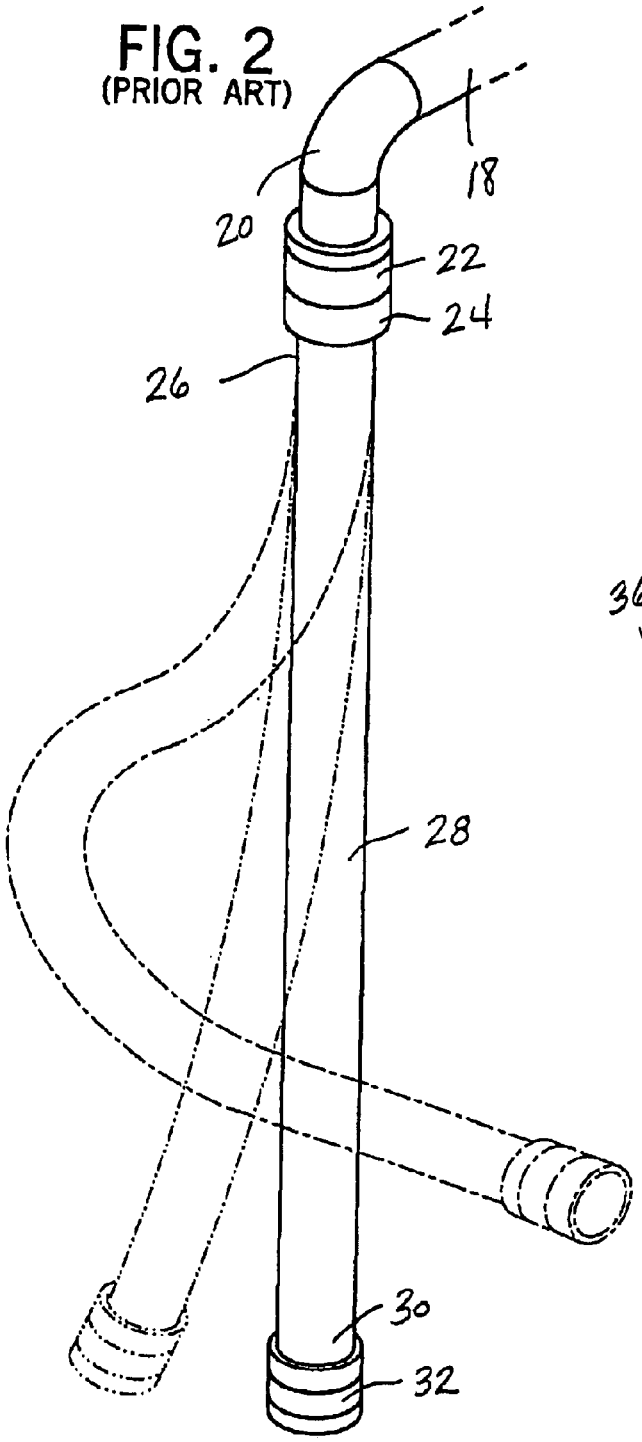
FIG. 2 (PRIOR ART)
FIG. 2 is a partial front perspective view illustrating a delivery hose utilized with a concrete pumping system of the prior art.
Figure 3:
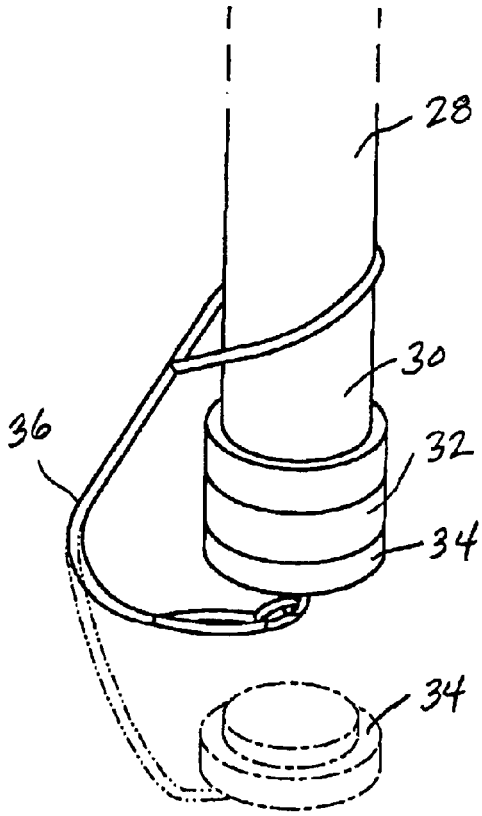
FIG. 3 (PRIOR ART)
FIG. 3 is a detailed view illustrating the attachment of an end cap to a metal fitting contained on one end of the delivery hose illustrated in FIG. 2.

As shown in the prior art diagrams of FIGS. 2 and 3, the end of the concrete supply pipe 18 includes an elbow 20 and a metal fitting 22. The metal fitting 22 receives a mating metal fitting 24 included on a first end 26 of a rubber delivery hose 28. Typically, the rubber delivery hose 28 has a length of up to twelve feet and is four inches in diameter. The concrete delivery hose 28 can be manipulated by the operator to direct concrete into a desired location, as illustrated by the broken lines in FIG. 2. As illustrated in FIG. 2, the second end 30 of the delivery hose 28 also includes a metal end fitting 32.

Referring to FIG. 3, the end fitting 32 included on the second end 30 of the delivery hose 28 is sized to receive a metal end cap 34. The end cap 34 is tethered to the delivery hose 28 by a flexible strap 36 such that the end cap 34 is not lost during usage of the mobile concrete pumping vehicle.

In the prior art system shown in FIGS. 2 and 3, the end cap 34 is attached to the end fitting 32 to prevent concrete from dripping out of the second end 30 when the boom arm is moved at the work site. Typically, when a user has finished supplying concrete to a specific location, the concrete pump is shut off and the end cap 34 installed onto the end fitting 32 to prevent concrete from dripping out of the second end 30 of the delivery hose when the boom arm is rotated. Although the combination of the flexible cap 34 and the end fitting 32 adequately prevent concrete from inadvertently falling out of the second end 30, problems exist in using this type of capping system.

One problem that exists with the use of the end cap 34 and the end fitting 32 is the increased cost of utilizing two metal parts included on the second end 30 of the flexible rubber delivery hose 28. Additionally, the metal end fitting 32 and the end cap 34 increase the weight of the delivery hose 28. During movement of the boom arm 12 at the work site, the added weight at the second end 30 of the delivery hose 28 can cause injury to a worker if the second end 30 inadvertently contacts the worker.

Another problem associated with the use of an end cap 34 is the build-up of pressure that can occur in the delivery hose 28 if the end cap 34 is not removed prior to turning on the concrete pump on the mobile concrete pumping vehicle. If the concrete pump is turned on, the concrete pump beings to supply additional concrete through the supply pipe 18 to the delivery hose 28. Since the second end 30 of the delivery hose 28 is capped, the concrete in the delivery hose 28 and the supply pipe 18 is compressed by the operation of the concrete pump. When a user is ready to begin supplying concrete, the end cap 34 is removed, which results in a sudden discharge of concrete, which may cause the delivery hose to move uncontrollably, as illustrated in FIG. 2. Since the second end 30 of the delivery hose 28 includes the end fitting 32, uncontrolled movement of the delivery hose 28 has a potential to cause injury upon striking an operator.

As discussed previously, FIG. 1 illustrates a mobile concrete pumping vehicle 10 that includes a boom arm 12 having multiple sections 14*a*–14*c* that can be extended and rotated to direct the flow of concrete to a desired location at a work site. Concrete is received in a storage hopper 16 and a pumping mechanism included on the vehicle 10 pumps the supply of concrete through a concrete supply pipe 18 to the outermost end of the boom arm 12.

Figure 4:
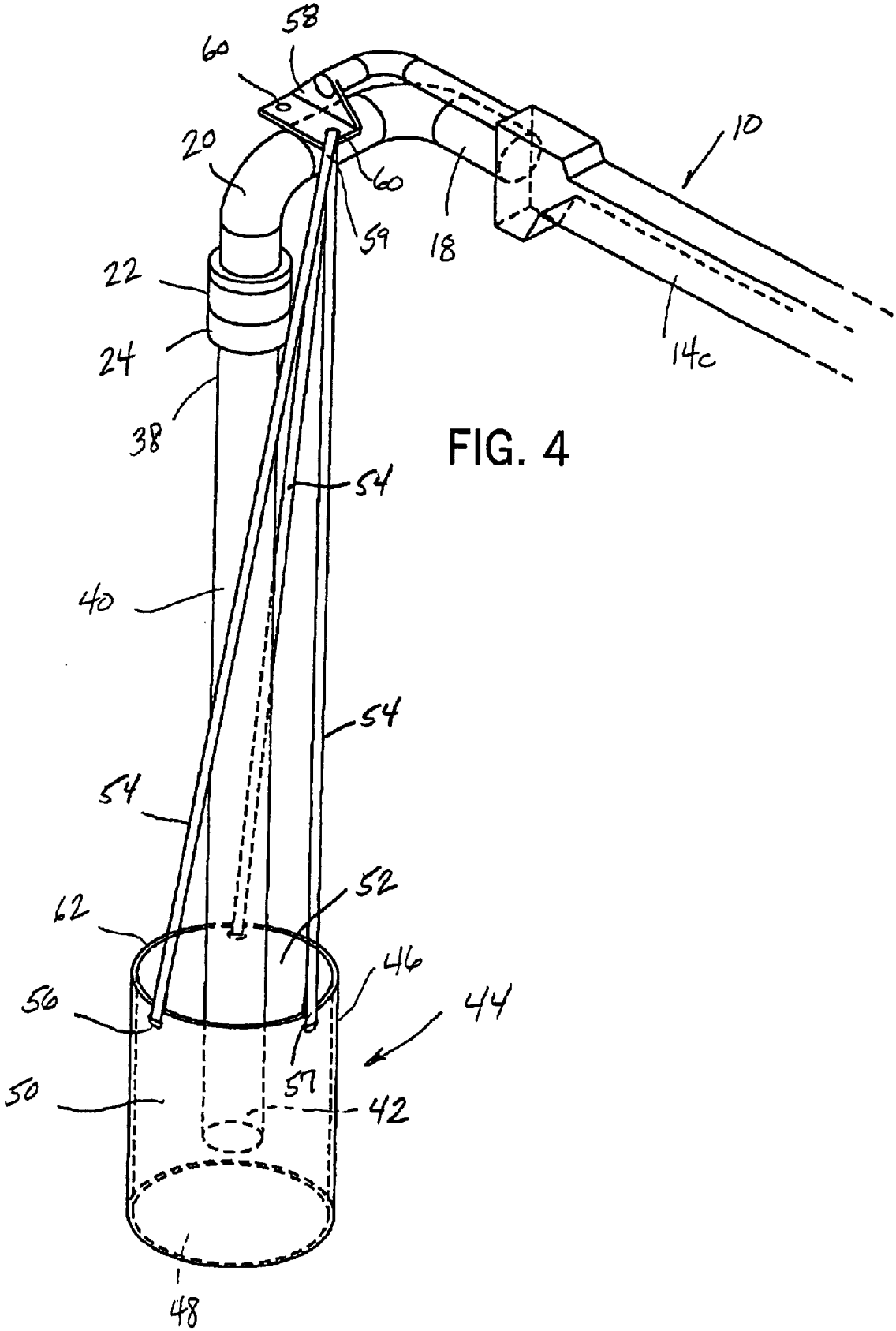
FIG. 4 is a front perspective view illustrating the system of the present invention, including a concrete delivery hose and catch basin.

Referring now to FIG. 4, the outer section 14*c* of the boom arm 10 includes the supply pipe 18, including the elbow 20. As illustrated, the elbow 20 includes the upper metal fitting 22 that mates with a corresponding metal fitting 24 contained on a first end 38 of a delivery hose 40 of the present invention. The metal fitting 24 formed on the first end 38 of the delivery hose 40 provides a fluid-tight seal with the concrete supply pipe 18 for pumped concrete to travel from the supply pipe 18 into the hollow, open interior of the delivery hose 40.

Figure 5:
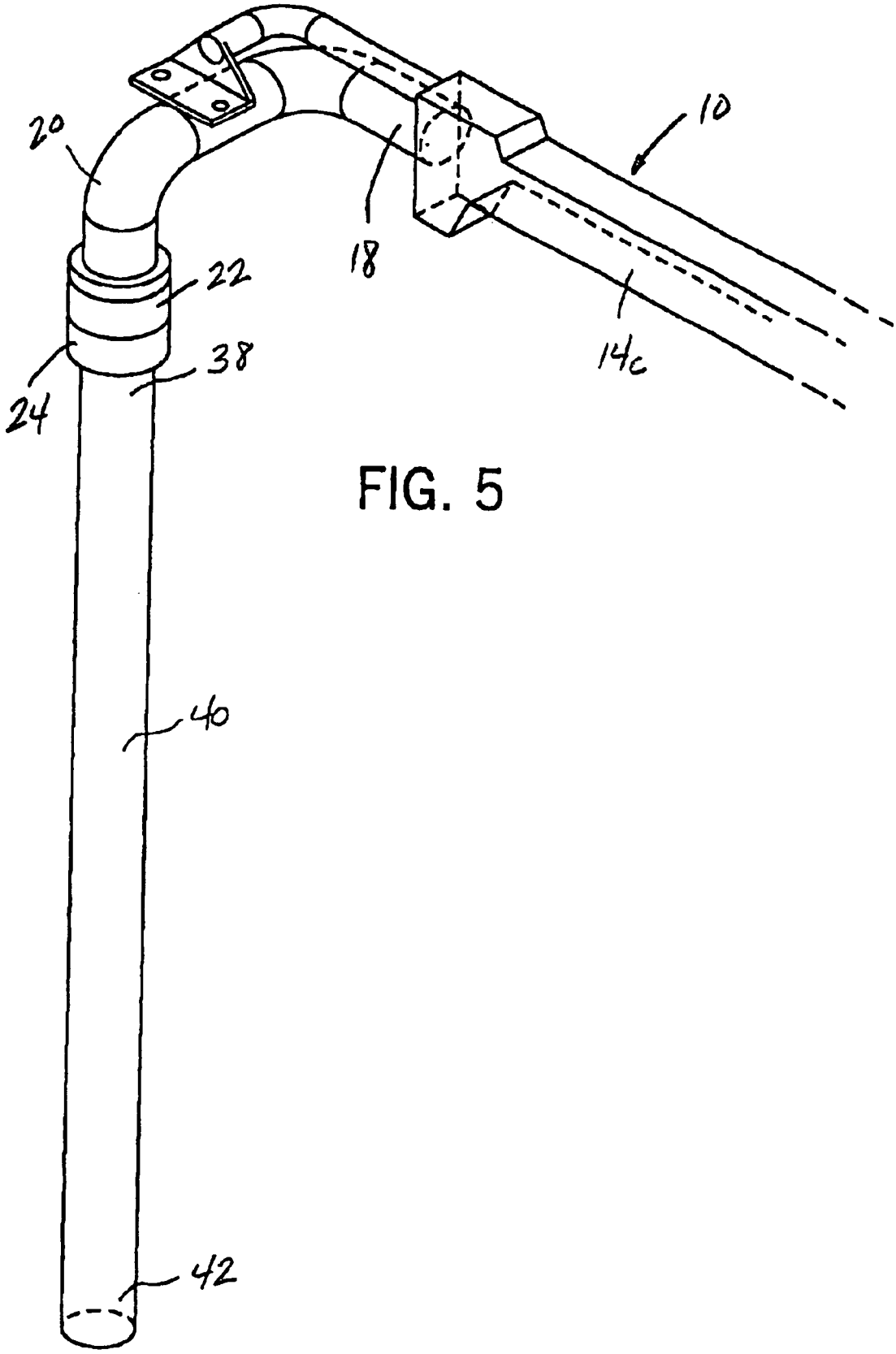
FIG. 5 is a perspective view illustrating the delivery hose of the present invention without a metal end fitting on the second end of the delivery hose.

As can be seen in FIG. 5, the delivery hose 40 extends to a second end 42 that is spaced from the first end 38 by the length of the delivery tube 40. In the preferred embodiment of the invention, the delivery tube 40 has a length between 8 feet and 12 feet, depending upon the specific requirements of the job site at which the mobile concrete pumping vehicle is being utilized.

In the preferred embodiment of the invention, the delivery hose 40 is formed from a flexible, rubber material and does not include an end fitting on the second end 42, as was shown in the prior art system of FIG. 2. The elimination of the end fitting at the second end 42 reduces the overall weight of the delivery tube 40 and decreases the cost of the delivery tube 40 relative to prior art systems.

As can be understood in FIG. 5, the removal of the metal end fitting from the second end 42 of the delivery tube 40 prevents an end cap from being utilized to control the undesired discharge of concrete from the second end 42 of the discharge tube 40 during movement of the boom arm at the work site. The elimination of the metal end fitting, therefore, requires the use of another type of system or device to control the undesired discharge of concrete from the second end 42 of the delivery hose 40.

Referring now to FIG. 4, thereshown is a catch basin 44 constructed in accordance with the present invention. The catch basin 44 is shown positioned to surround the second end 42 of the delivery hose 40. The catch basin 44, when positioned as shown in FIG. 4, collects undesired concrete that is discharged from the second end 42 of the delivery hose 40. The catch basin 44 is defined by an outer wall 46 and a bottom wall 48 which are joined to each other to define an open reservoir 50. The catch basin 44 has an open top end 52 that allows the delivery hose 40 to be received within the open reservoir 50.

As shown in FIG. 4, in the preferred embodiment of the invention, the outer wall 46 has a cylindrical shape. However, it is contemplated by the inventor that the outer wall 46 could have various other shapes as long as the catch basin 44 defines an open reservoir 50 for receiving and retaining discharged concrete.

In the preferred embodiment of the invention, the outer wall 46 is formed from a durable, flexible material, such as a heavy-duty cloth or similar material. As illustrated, the diameter of the outer wall 46 is greater than the outer diameter of the delivery hose 40 such that the catch basin 44 is spaced from the outer surface of the delivery hose 40.

As illustrated in FIG. 4, the catch basin 44 includes a plurality of suspension straps 54 that each pass through an opening 56 formed in the outer wall 46 of the catch basin 44 near the open top end 52. Each of the suspension straps 54 extends from a first end 57 connected to the catch basin 44 to a second end 59 connected to a support bracket 58 mounted to the supply pipe 18. The support bracket 58 includes a pair of openings 60, each of which can receive one of the suspension straps 54. Since the delivery hose 40 is typically in a vertical orientation, as shown in FIG. 4, the suspension straps support the weight of the catch basin 44 to suspend the catch basin 44 as illustrated.

As can be understood in FIG. 4, the depth of insertion of the delivery hose 40 into the catch basin 44 is directly controlled by the length of the suspension straps 54. In the preferred embodiment of the invention, the length of the suspension straps 54 can be adjusted to control the depth at which the delivery hose 40 extends into the reservoir 50 formed by the catch basin 44.

As illustrated in FIG. 4, the top edge surface 62 extends above the second end 42 of the delivery hose 40 and toward the first end 38 of the hose. It is important that the top edge 62 extend above the second end 42 such that discharged concrete is retained within the reservoir 50, rather than splashing over the top edge 62.

During normal operations of the mobile concrete pumping vehicle, the catch basin 44 is detached from the support bracket 58 such that the catch basin 44 does not interfere with the concrete pumping operation. Once a sufficient amount of concrete has been placed in a desired location, the catch basin 44 is positioned around the second end 42 of the delivery hose 40 and the suspension straps 54 are connected to the support bracket 58. Once the catch basin 44 is properly suspended, as illustrated in FIG. 4, the boom arm 10 of the concrete pumping vehicle can be moved without spilling concrete onto undesired locations at the work site. Once the boom arm is in place, the catch basin 44 and suspension straps 54 are removed and normal pumping operations begin.

A significant advantage of the catch basin 44 illustrated in FIG. 4 as compared to the end cap 34 shown in FIG. 3 is the loose fitting of the catch basin 44 around the second end 42 of the delivery hose 40. If the pump of the mobile concrete pumping vehicle 10 is operated with the catch basin 44 in place, the catch basin will immediately collect the discharged concrete until the reservoir 50 has been filled. Hopefully, the operator of the pumping vehicle will be able to identify this problem and terminate operation of the pump before much concrete has been discharged. Thus, the catch basin 44 prevents the build-up of pressure in the supply pipe 18 and the delivery hose 40 as was the case with the end cap and metal fitting of the disclosed prior art.

When utilizing the system of the prior art, as shown in FIG. 3, if the concrete pumping vehicle begins operation with the end cap 34 in place, a significant amount of pressure can be built up within the boom pipe and delivery hose 28. If the end cap 34 is removed at this time, concrete is sprayed out of the second end of the delivery hose, which creates a large mess and possibly injury to the operator of the pumping vehicle.

Although the system of the present invention is shown and described as being used with a mobile concrete pumping vehicle, it should be understood that the delivery hose and catch basin of the present invention could be utilized with other types of concrete pumping systems not positioned on a mobile vehicle. Further, although the cylindrical catch basin 44 is shown as the preferred embodiment of the invention, it should be understood that various other configurations and materials could be used to create the catch basin 44 of the present invention.

Various alternatives and embodiments are contemplated as being within the scope of the following claims particularly pointing out and distinctly claiming the subject matter regarded as the invention.

I claim:

1. A combination system for delivering concrete from a mobile concrete pump having a concrete supply pipe mounted to a multi-section movable boom arm and for preventing the undesired discharge of concrete from the concrete supply pipe during movement of the boom arm, the system comprising:

a concrete delivery hose extending from a first end to a second end, the first end of the delivery hose including an end fitting for attachment to the concrete supply pipe, wherein the second end of the delivery hose is formed from rubber; and a catch basin removably positioned to surround the second end of the delivery hose to collect concrete discharged from the second end of the delivery hose;

wherein the catch basin includes a plurality of suspension straps each attachable to the boom arm to suspend the catch basin around the second end of the delivery hose.

2. The system of claim 1 further comprising a support bracket mounted to the boom arm, the support bracket providing a point of attachment for the plurality of suspension straps.

3. The system of claim 1 wherein the catch basin includes at least three suspension straps.

4. A collection device for collecting undesired discharged concrete from a mobile concrete pump having a concrete supply pipe mounted to a multi-section movable boom arm, the boom arm including a rubber delivery hose having a first end connected to the concrete supply pipe and a second end for directing a flow of concrete for delivery to a work site, the collection device comprising:

a catch basin having an outer wall and a bottom wall for defining a collection reservoir having a volume sufficient to collect the undesired discharged concrete; and a plurality of suspension straps for supporting the catch basin around the second end of the delivery hose, each suspension strap having a first end connected to the catch basin and a second end attachable to the boom arm.

5. The collection device of claim 4 wherein the outer wall of the catch basin is sized to be spaced from the delivery hose when the catch basin is suspended around the second end of the delivery hose.

6. The collection device of claim 4 further comprising a support bracket mounted to the boom arm, the support bracket providing a point of attachment for the second ends of the plurality of suspension straps.

7. The collection device of claim 4 wherein the collection basin is formed from a flexible material.

* * * * *